US010446966B2

(12) United States Patent
Mori et al.

(10) Patent No.: US 10,446,966 B2
(45) Date of Patent: Oct. 15, 2019

(54) SPRING CONTACT AND METHOD OF MANUFACTURING SAME

(71) Applicant: ALPS ALPINE CO., LTD., Tokyo (JP)

(72) Inventors: Toshiharu Mori, Miyagi (JP); Keisuke Yamazaki, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 16/200,794

(22) Filed: Nov. 27, 2018

(65) Prior Publication Data

US 2019/0097345 A1 Mar. 28, 2019

Related U.S. Application Data

(63) Continuation of application No. PCT/JP2017/020573, filed on Jun. 2, 2017.

(30) Foreign Application Priority Data

Jun. 17, 2016 (JP) ..... 2016-120894

(51) Int. Cl.
*H01R 13/24* (2006.01)
*H01R 43/16* (2006.01)

(52) U.S. Cl.
CPC ..... *H01R 13/2428* (2013.01); *H01R 13/24* (2013.01); *H01R 43/16* (2013.01)

(58) Field of Classification Search
CPC . H01R 13/2428; H01R 43/16; H01R 13/2407
(Continued)

(56) References Cited

U.S. PATENT DOCUMENTS 5,297,967 A * 3/1994 Baumberger ..... H05K 7/1069 439/66
5,857,857 A * 1/1999 Fukuda ..... H01R 13/7032 439/188

(Continued)

FOREIGN PATENT DOCUMENTS

JP H06-203933 7/1994
JP 2005-129428 5/2005

(Continued)

OTHER PUBLICATIONS

International Search Report dated Aug. 22, 2017 in PCT/JP2017/020573 filed on Jun. 2, 2017.

(Continued)

*Primary Examiner* — Tulsidas C Patel
*Assistant Examiner* — Peter G Leigh
(74) *Attorney, Agent, or Firm* — IPUSA, PLLC

(57) ABSTRACT

A spring contact to which a compressive load is to be imposed includes a base, a first elastic arm of a helical shape, a first contact, a second elastic arm of a helical shape, and a second contact. The first elastic arm includes a first fixed end supported on the base and a first end portion at a free end. The first contact is provided at the first end portion and protruding in a direction from which the load acts. The second elastic arm includes a second fixed end supported on the base and a second end portion at a free end. The second contact is provided at the second end portion. The second contact is placed independent of the first contact and protrudes in the direction from which the load acts.

10 Claims, 10 Drawing Sheets

(58) Field of Classification Search
USPC ..... 439/884, 66
See application file for complete search history.

(56) References Cited

U.S. PATENT DOCUMENTS

| | | | | |
|---|---|---|---|---|
| 6,626,708 | B2 * | 9/2003 | Phillips | H01R 13/2428 439/515 |
| 6,855,010 | B1 * | 2/2005 | Yen | H01R 13/2428 439/700 |
| 7,219,426 | B2 * | 5/2007 | Haga | G01R 1/0466 29/874 |
| 7,393,214 | B2 * | 7/2008 | DiStefano | H01R 13/2407 439/66 |
| 7,559,770 | B2 * | 7/2009 | Di Stefano | H01R 13/2407 439/66 |
| 7,833,256 | B2 * | 11/2010 | Biedermann | A61B 17/7004 606/300 |
| 8,029,291 | B2 * | 10/2011 | Park | B21F 3/02 439/66 |
| 8,118,604 | B2 * | 2/2012 | Ma | H01R 13/2435 439/66 |
| 8,263,879 | B2 * | 9/2012 | Hougham | H01R 12/7082 174/260 |
| 8,651,877 | B2 * | 2/2014 | Hougham | H01L 21/486 439/66 |
| 8,690,602 | B2 * | 4/2014 | Flaherty, IV | H01R 13/111 439/578 |
| 2005/0088193 | A1 * | 4/2005 | Haga | G01R 1/0466 324/756.02 |
| 2011/0111647 | A1 * | 5/2011 | Hougham | H01L 21/486 439/884 |
| 2014/0004721 | A1 * | 1/2014 | Stein | H01B 17/58 439/63 |
| 2014/0004722 | A1 * | 1/2014 | Stein | H01B 17/58 439/63 |
| 2014/0199895 | A1 * | 7/2014 | Chui | G01R 1/06722 439/824 |
| 2014/0329421 | A1 * | 11/2014 | Tatzel | H01R 12/714 439/816 |
| 2015/0340789 | A1 * | 11/2015 | Yokota | H01R 43/16 439/816 |

FOREIGN PATENT DOCUMENTS

| | | |
|---|---|---|
| JP | 2010-118256 | 5/2010 |
| JP | 2016-001583 | 1/2016 |
| WO | 2010/055872 | 5/2010 |

OTHER PUBLICATIONS

Office Action dated Jul. 13, 2018, issued to TW Application No. 106113798.

* cited by examiner

SPRING CONTACT AND METHOD OF MANUFACTURING SAME

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2017/020573, filed on Jun. 2, 2017 and designating the U.S., which claims priority to Japanese patent application No. 2016-120894, filed on Jun. 17, 2016. The entire contents of the foregoing applications are hereby incorporated herein by reference.

BACKGROUND OF THE INVENTION

1. Field of the Invention

The present invention relates to spring contacts.

2. Description of the Related Art

For example, as contact means used for electrical connecting parts of electronics, a spring contact described in Japanese Laid-open Patent Publication No. 2010-118256 (Patent Document 1) is known. According to the spring contact of Patent Document 1, however, a pair of elastic contact arms are formed in a planar double spiral, and therefore, it is difficult to reduce a mounting area necessary for mounting on electronics. Reducing the width of the elastic contact arms to reduce the mounting area decreases a spring constant, thus preventing a stable connection from being established. Therefore, a spring contact (spring connector) improved to allow reduction of the mounting area as illustrated in Japanese Laid-open Patent Publication No. 2016-1583 (Patent Document 2) has been developed.

SUMMARY OF THE INVENTION

According to an aspect of the present invention, a spring contact to which a compressive load is to be imposed includes a base, a first elastic arm of a helical shape, a first contact, a second elastic arm of a helical shape, and a second contact. The first elastic arm includes a first fixed end supported on the base and a first end portion at a free end. The first contact is provided at the first end portion and protruding in a direction from which the load acts. The second elastic arm includes a second fixed end supported on the base and a second end portion at a free end. The second contact is provided at the second end portion. The second contact is placed independent of the first contact and protrudes in the direction from which the load acts.

According to an aspect of the present invention, a method of manufacturing a spring contact includes forming a first portion including a first contact and a second portion including a second contact in a material formed of a metal plate, forming a first elastic arm having a first spring constant and including a first end portion by helically bending the first portion, forming a second elastic arm having a second spring constant greater than the first spring constant and including a second end portion by helically bending the second portion, disposing the first end portion and the second end portion such that an end face of the first end portion faces a back face of the second end portion with respect to a direction in which a load is applied, simultaneously deflecting the first elastic arm and the second elastic arm such that the second elastic arm goes beyond an elastic limit with the first elastic arm being within an elastic limit by imposing a compressive load simultaneously on the first end portion and the second end portion, and with the load being removed, causing the end face of the first end portion to contact the back face of the second end portion and causing an initial load to be generated in the first elastic arm, through the amount of spring back of the second elastic arm being smaller than the amount of spring back of the first elastic arm.

DETAILED DESCRIPTION OF THE PREFERRED EMBODIMENTS

The spring contact of Patent Document 2 includes a pair of elastic arms (a first elastic arm and a second elastic arm) that are helically wound, and a load acts on each elastic arm in a plate width direction as in a volute spring. Therefore, it is possible to place the elastic arms of a large spring constant compactly in a small mounting area. According to this, however, only a contact provided on the first elastic arm contacts a connection target member, and the second elastic arm operates as an auxiliary spring for the first elastic arm. Therefore, the electrical connection with the connection target member is established only through the contact provided on the first elastic arm. Therefore, a diligent study has been made to achieve a more reliable connection with respect to a spring contact advantageously characterized by a small mounting area.

According to an aspect of the present invention, a spring contact whose mounting area is small and that can establish a stable connection to a connection target member is provided.

According to a spring contact of an embodiment of the present invention, a first contact provided in a first elastic arm and a second contact provided in a second elastic arm contact a connection target member independent of each other, so that it is possible to establish a stable connection to the connection target member.

A spring contact 1A according to a first embodiment is described below with reference to FIGS. 1 through 12.

Figure 1:
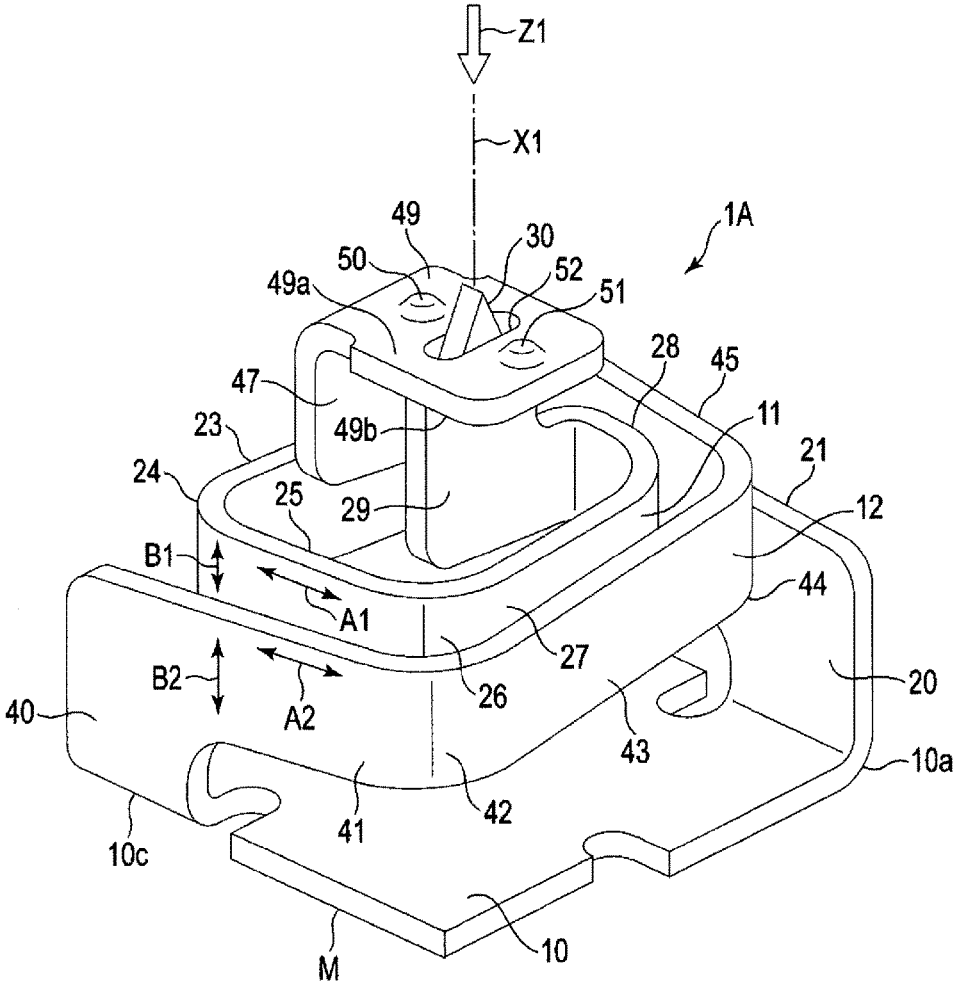
FIG. 1 is a perspective view of a spring contact according to a first embodiment.
Figure 2:
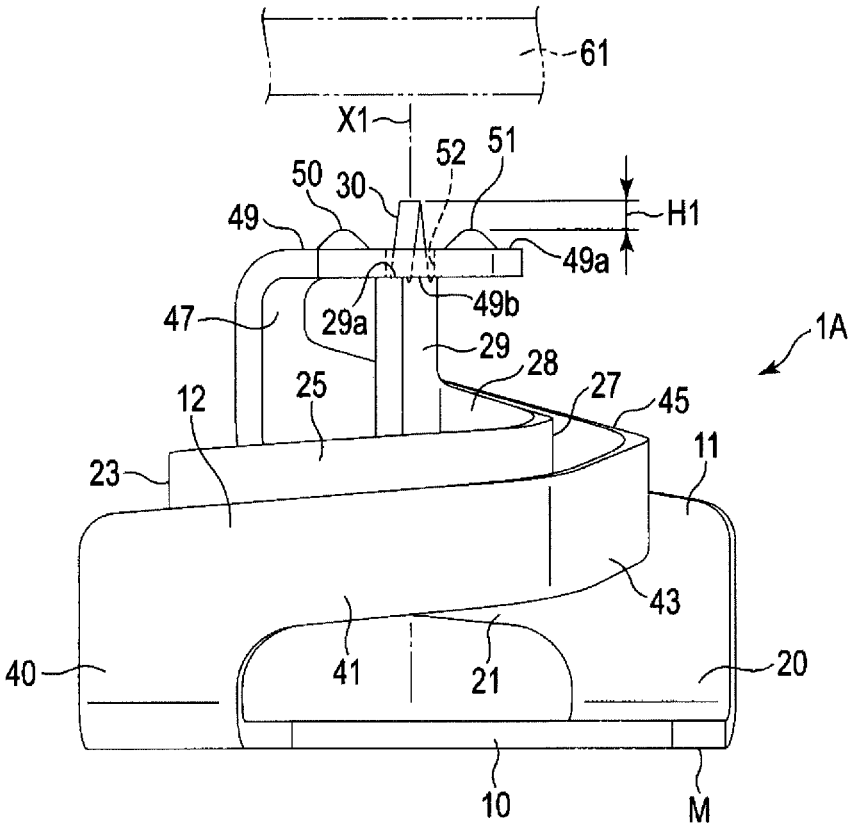
FIG. 2 is a front view of the spring contact illustrated in FIG. 1.
Figure 3:
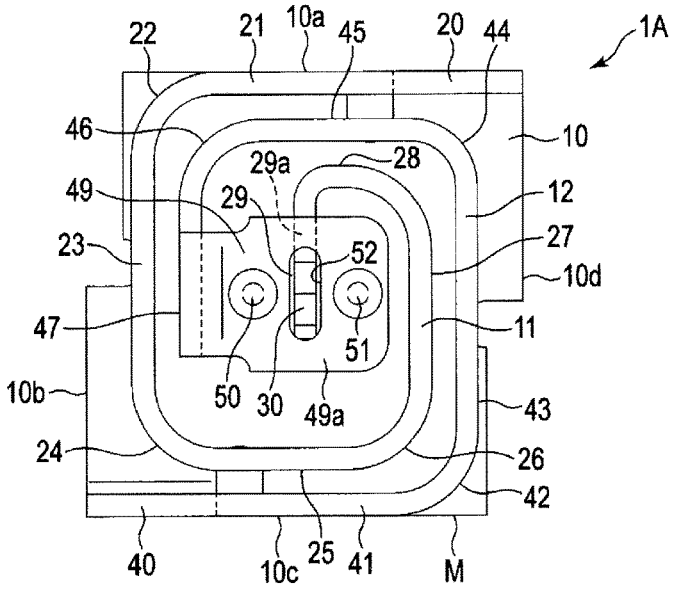
FIG. 3 is a plan view of the spring contact illustrated in FIG. 1.

FIG. 1 is a perspective view of the spring contact 1A. A compressive load is applied to the spring contact 1A from a direction indicated by the arrow Z1 in FIG. 1. FIG. 2 is a front view of the spring contact 1A. In this embodiment, for convenience of description, a virtual line segment along the load applied to the spring contact 1A is referred to as a load action line X1 (illustrated in FIGS. 1 and 2). FIG. 3 is a plan view of the spring contact 1A viewed from a direction from which the load is applied.

The spring contact 1A of this embodiment is formed by shaping a single springy metal plate M by precision pressing or the like, and includes a base 10 having a flat plate shape, a first elastic arm 11 that is part of the metal plate M and shaped into a helix, and a second elastic arm 12 that is also part of the metal plate M and shaped into a helix. The base 10, the first elastic arm 11, and the second elastic arm 12 are formed of a single metal plate. Therefore, the base 10, the first elastic arm 11, and the second elastic arm 12 are equal in thickness. As another embodiment, the first elastic arm 11 and the second elastic arm 12 may be formed of separate parts, and these elastic arms 11 and 12 may be fixed to the metal base 10 by fixing means such as welding or "joining through plastic deformation." The material of the metal plate M is not limited in particular, and may be, for example, phosphor bronze subjected to anti-oxidation treatment such as gold plating, or springy stainless steel.

As illustrated in FIG. 3, in a plan view of the spring contact 1A, an example of the base 10 has a substantially quadrangular shape. That is, this base 10 has a first side 10*a*, a second side 10*b*, a third side 10*c*, and a fourth side 10*d*. The dimensions of the base 10 are not limited in particular. Depending on the size and the degree of integration of an electronic component in which the spring contact 1A is used, the base 10 is compact in size with each of the sides 10*a* through 10*d* having a length of less than 2 mm, for example, a length of 1.4 mm.

The first elastic arm 11 has a strip shape, and is bent into a helix as described below. In FIG. 1, the arrows A1 indicate the longitudinal directions of the first elastic arm 11, and the arrows B1 indicate the plate width directions of the first elastic arm 11. The second elastic arm 12 as well has a strip shape and is bent into a helix. In FIG. 1, the arrows A2 indicate the longitudinal directions of the second elastic arm 12, and the arrows B2 indicate the plate width directions of the second elastic arm 12. The length of the first elastic arm 11 is greater than the length of the second elastic arm 12.

Figure 4:
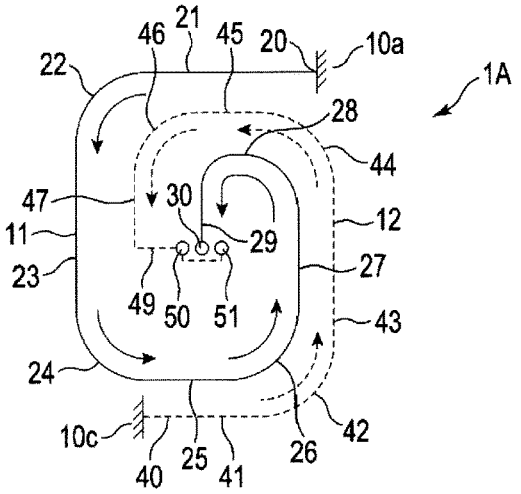
FIG. 4 is a schematic plan view of a first elastic arm and a second elastic arm of the spring contact illustrated in FIG. 1.

FIG. 4 is a schematic plan view of the first elastic arm 11 and the second elastic arm 12. In FIG. 4, the first elastic arm 11 is indicated by a solid line and the second elastic arm 12 is indicated by a dashed line. As illustrated in FIGS. 3 and 4, in a plan view of the spring contact 1A, the first elastic arm 11 and the second elastic arm 12 are spirally wound, being spaced to avoid contacting each other. In some cases, part of the first elastic arm 11 and part of the second elastic arm 12 may contact each other.

The first elastic arm 11 is helically wound such that the plate width directions (indicated by the arrows B1 in FIG. 1) are along the load action line X1, and a compressive load acts on the first elastic arm 11 in its plate width direction as in a volute spring. The second elastic arm 12 as well is helically wound such that the plate width directions (indicated by the arrows B2 in FIG. 1) are along the load action line X1, and a compressive load acts on the second elastic arm 12 in its plate width direction. The length of the first elastic arm 11 is greater than the length of the second elastic arm 12. Therefore, the spring constant (k1) of the first elastic arm 11 is smaller than the spring constant (k2) of the second elastic arm 12.

An example of the first elastic arm 11 includes a first fixed end 20 standing up substantially perpendicularly from the first side 10*a* (illustrated in FIG. 3) of the base 10, a first extending portion 21 extending in a direction along the first side 10*a* from the first fixed end 20, a first continuous portion 23 extending in a direction along the second side 10*b* via a curving portion 22, a first intermediate portion 25 extending in a direction along the third side 10*c* via a curving portion 24, a first extension portion 27 extending in a direction along the fourth side 10*d* via a curving portion 26, an end-side bending portion 28 bending into a U-shape, and a first end portion 29.

The first end portion 29 is positioned at the free end of the first elastic arm 11. The first end portion 29 has a flat plate shape, and its plate surfaces extend in a direction along the load action line X1 (a vertical direction). A sharpened first contact 30 protruding in a direction along the load action line X1 is formed at the end of the first end portion 29.

The first elastic arm 11 is helically shaped such that its turn angle is 360° or more (for example, approximately 450°). The term "turn angle" here is an angle from the first fixed end 20 to the first end portion 29 with a single turn around the load action line X1 being 360°. The first elastic arm 11 of this embodiment bends inward 90° at each of the three curving portions 22, 24 and 26 and further bends substantially 180° at the end-side bending portion 28. Therefore, with one turn being 360°, the turn angle of the first elastic arm 11 is approximately 450° (1.25 turns). The plate width of the first elastic arm 11 may be constant over the entire length of the first elastic arm 11. Alternatively, the first elastic arm 11 may taper to gradually decrease in plate width toward the first end portion 29 from the first fixed end 20.

The first extending portion 21, the first continuous portion 23, the first intermediate portion 25, the first extension portion 27, and the curving portions 22, 24 and 26 serve as a spring effect part for effecting the deflection of the first elastic arm 11. That is, with the first elastic arm 11 deflecting with a load input from the first contact 30 to the first elastic arm 11 (a load in a direction along the load action line X1), the first elastic arm 11 stores elastic energy to generate a repulsive load.

The second elastic arm 12 has a helical shape along the first elastic arm 11. That is, the second elastic arm 12 includes a second fixed end 40 standing up substantially perpendicularly from the third side 10*c* (illustrated in FIG. 3) of the base 10, a second extending portion 41 extending in a direction along the third side 10*c* from the second fixed end 40, a second continuous portion 43 extending in a direction along the fourth side 10*d* via a curving portion 42, a second intermediate portion 45 extending in a direction along the first side 10*a* via a curving portion 44, a second extension portion 47 extending in a direction along the second side 10*b* via a curving portion 46, and a second end portion 49. Thus, the fixed end 40 of the second elastic arm 12 is formed to extend from a side opposite to the fixed end 20 of the first elastic arm 11 across a flat plate, and the second elastic arm 12 has a helical shape along the first elastic arm 11. Therefore, it is possible to dispose the first elastic arm 11 and the second elastic arm 12 in a space-efficient manner.

The second end portion 49 is positioned at the free end of the second elastic arm 12. The second end portion 49 has a flat plate shape, and its plate surfaces extend in a direction perpendicular to the load action line X1, namely, in a direction parallel to the base 10 (in a lateral direction). A pair of second contacts 50 and 51 are formed on an end face 49*a* of the second end portion 49. Each of the second contacts 50 and 51 has a conical shape protruding in a direction along the load action line X1 with the top of the protruding shape forming part of a spherical surface. Furthermore, an elongated through hole 52 is formed between the second contacts 50 and 51 in the second end portion 49. While this embodiment includes the two second contacts 50 and 51, the number of second contacts may be one or more than two. The second contacts 50 and 51 may have a pointed shape.

The second elastic arm 12 is helically shaped such that its turn angle is 360° or less (for example, approximately 270°). The term "turn angle" here is an angle from the second fixed end 40 to the second end portion 49 with a single turn around the load action line X1 being 360°. The second elastic arm 12 of this embodiment bends inward 90° at each of the three curving portions 42, 44 and 46. Therefore, with one turn being 360°, the turn angle of the second elastic arm 12 is approximately 270° (0.75 turns). The plate width of the second elastic arm 12 may be constant over the entire length of the second elastic arm 12. Alternatively, the second elastic arm 12 may taper to gradually decrease in plate width toward the second end portion 49 from the second fixed end 40.

The second extending portion 41, the second continuous portion 43, the second intermediate portion 45, the second extension portion 47, and the curving portions 42, 44 and 46 serve as a spring effect part for effecting the deflection of the second elastic arm 12. That is, with the second elastic arm 12 deflecting with a load input from the second contacts 50 and 51 to the second elastic arm 12 (a load in a direction along the load action line X1), the second elastic arm 12 stores elastic energy to generate a repulsive load.

FIG. 2 illustrates the first elastic arm 11 and the second elastic arm 12 to which no external force (load) is applied (a free state). As illustrated in FIG. 2, with an end face 29*a* of the first end portion 29 contacting a back face 49*b* of the second end portion 49, the first elastic arm 11 is elastically supported by the second elastic arm 12, so that an initial load (pre-tension) is applied to the first elastic arm 11. The first contact 30 passes through the through hole 52 of the second end portion 49 to protrude outward (upward in FIG. 2) from the end face 49*a* of the second end portion 49.

As illustrated in FIG. 2, in the free state where no external force is applied to the first elastic arm 11 and the second elastic arm 12, the first contact 30 protrudes in a direction along the load action line X1 from the through hole 52 of the second end portion 49, and the first contact 30 is disposed between the second contacts 50 and 51 to be side by side with the second contacts 50 and 51 in a plane direction (a direction along the end face 49*a*) in a plan view. The end of the first contact 30 protrudes more than the ends of the second contacts 50 and 51 by a height H1 (illustrated in FIG. 2).

Thus, according to the spring contact 1A of this embodiment, the end face 29*a* of the first end portion 29 is placed on the side facing the back face 49*b* of the second end portion 49 with respect to a direction in which a load is applied (the load action line X1). In the free state where no load is applied, the end face 29*a* of the first end portion 29 contacts the back face 49*b* of the second end portion 49 with elastic energy stored, so that an initial load is generated in the first elastic arm 11.

Figure 5:
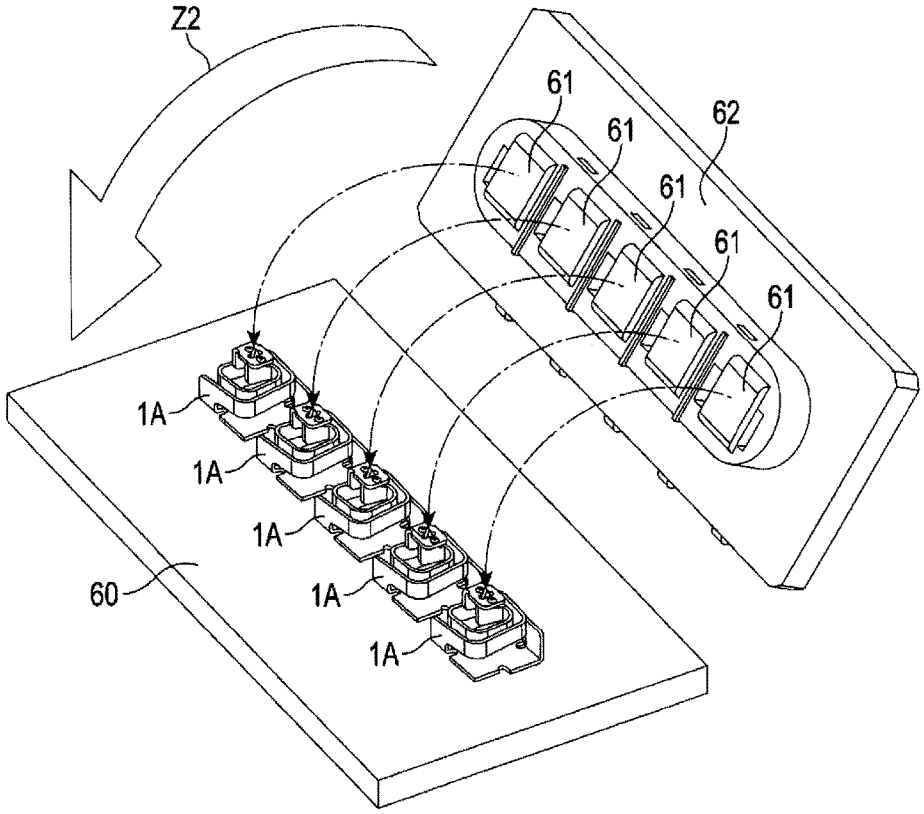
FIG. 5 is a perspective view of an example of a circuit board on which the spring contacts illustrated in FIG. 1 are disposed and connection target members.

FIG. 5 is a perspective view of an example of a first circuit board 60 on which multiple spring contacts 1A are disposed and a second circuit board 62 on which multiple connection target members 61 are disposed. On the second circuit board 62, the connection target members 61, each being a wiring pattern or a terminal, are disposed at positions each corresponding to one of the spring contacts 1A on the first circuit board 60. When the second circuit board 62 is placed over the first circuit board 60 as indicated by the arrow Z2 in FIG. 5, the spring contacts 1A and the corresponding connection target members 61 contact each other.

Figure 6:
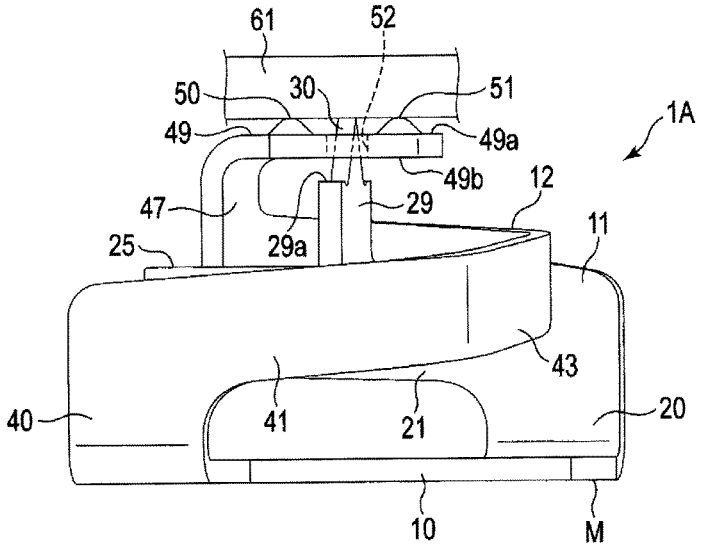
FIG. 6 is a front view of the spring contact illustrated in FIG. 1 to which a load is imposed.
Figure 7:
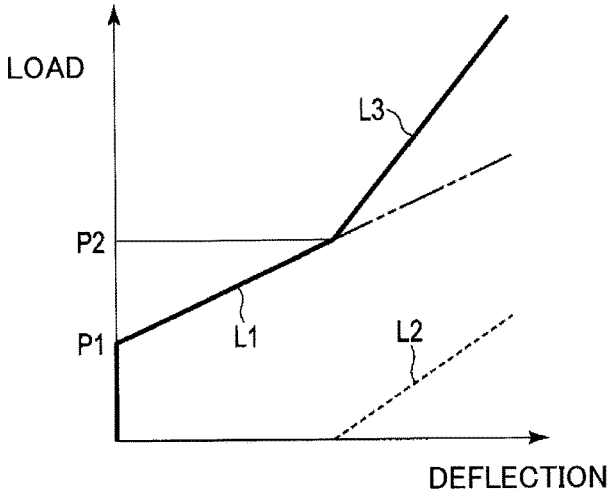
FIG. 7 is a graph illustrating a load-deflection relationship of the spring contact illustrated in FIG. 1.

FIG. 6 illustrates the spring contact 1A to which a compressive load is applied by the connection target member 61 contacting the spring contact 1A. FIG. 7 illustrates a load-deflection relationship (a load-deflection characteristic) of the spring contact 1A.

During a transition from the free state illustrated in FIG. 2 to a loaded state illustrated in FIG. 6, first, the first contact 30 contacts the connection target member 61. Therefore, the first contact 30 alone is independently pressed by the connection target member 61, so that the first elastic arm 11 alone deflects. The first elastic arm 11 is supported by the second end portion 49 with an initial load (pre-tension) applied to the first elastic arm 11. Therefore, an initial load P1 commensurate with the pre-tension (illustrated in FIG. 7) rises at the beginning of the contact of the first contact 30 with the connection target member 61.

Therefore, the load concentrates on the sharp end of the first contact 30, so that a great contact pressure is obtained. Even if a film having a high electric resistance value, such as an oxide film, is formed on the surface of the connection target member 61, it is possible to ensure a good electrical connection because the film is broken by the sharp end of the first contact 30.

When the spring contact 1A is further compressed by the connection target member 61, so that the deflection of the first elastic arm 11 increases, the second contacts 50 and 51 as well contact the connection target member 61 as illustrated in FIG. 6. Therefore, the first elastic arm 11 and the second elastic arm 12 both deflect. That is, as illustrated in FIG. 7, when the load exceeds P2, a load that is generated in accordance with the spring constant of the second elastic arm 12 (a load-deflection characteristic indicated by a dashed line L2 in FIG. 7) is added to a load that is generated in accordance with the spring constant of the first elastic arm 11, and is applied to the connection target member 61. Therefore, the spring constant of the spring contact 1A increases, which is the same as the spring constant of the second elastic arm 12 is added to the spring constant of the first elastic arm 11, thus resulting in a nonlinear load-deflection characteristic according to which the load increases after the load P2 as indicated by a solid line L3 in FIG. 7. According to the spring contact 1A of this embodiment, the first contact 30 is inserted in the through hole 52 formed in the second end portion 49, and the first contact 30 and the second contacts 50 and 51 each protrude in a direction from which a load acts. Furthermore, the second contacts 50 and 51 are separately disposed at symmetrical positions one on each side of the first contact 30. Therefore, with the first contact 30 on the load action line X1 being in the center, a contact pressure due to the first contact 30 and the second contacts 50 and 51 can be applied to the connection target member 61. Furthermore, because the first contact 30 in inserted in and guided by the through hole 52, it is possible to reduce deformation of the first elastic arm 11 of a small spring constant in a plane direction and also to reduce deformation of the second elastic arm 12 in a plane direction.

With the first contact 30 and the second contacts 50 and 51 contacting the connection target member 61 as illustrated in FIG. 6, vibrations of various frequencies may be applied to the spring contact 1A or the connection target member 61. Therefore, according to the spring contact 1A of this embodiment, the spring constant (k1) of the first elastic arm 11 and the spring constant (k2) of the second elastic arm 12 differ from each other so that the resonance frequency of the first elastic arm 11 and the resonance frequency of the second elastic arm 12 differ from each other.

According to this embodiment, the length of the first elastic arm 11 is greater than the length of the second elastic arm 12. There is no substantial difference between the plate width of the first elastic arm 11 and the plate width of the second elastic arm 12. By so doing, the spring constant (k1) of the first elastic arm 11 is made smaller than the spring constant (k2) of the second elastic arm 12, and the first elastic arm 11 and the second elastic arm 12 are caused to differ in resonance frequency from each other.

Therefore, even if vibrations of a particular frequency are applied to the spring contact LA or the connection target member 61, it is possible to prevent the first elastic arm 11 and the second elastic arm 12 from resonating simultaneously and causing the first contact 30 and the second contacts 50 and 51 to simultaneously separate from the connection target member 61, so that it is possible to avoid conduction failure due to vibrations. This also is effective in achieving good connection by the spring contact 1A.

Next, an example of a method of manufacturing the spring contact 1A according to this embodiment is described with reference to FIGS. 8 through 12.

Figure 8:
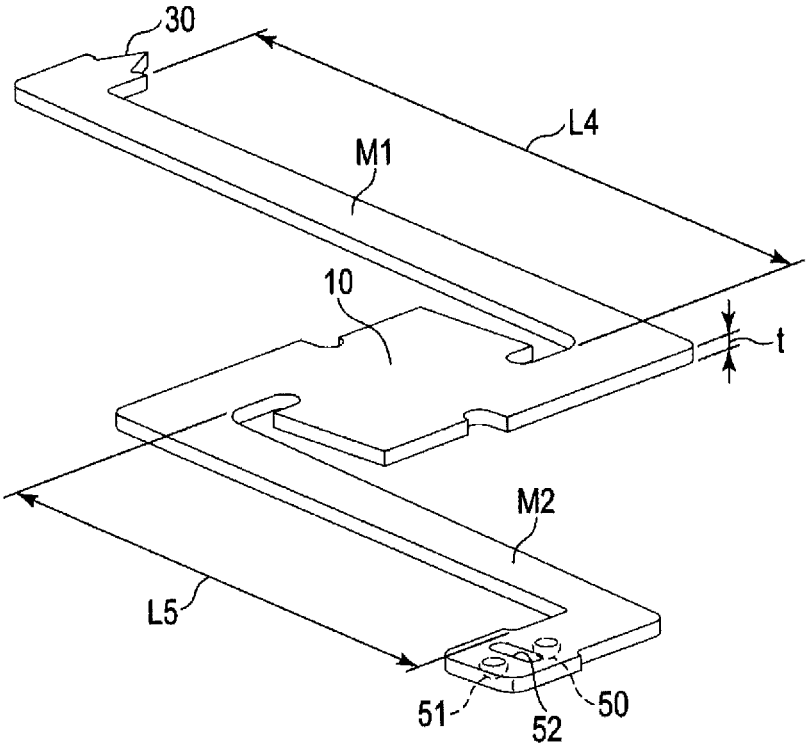
FIG. 8 is a perspective view of a material (metal plate) of the spring contact illustrated in FIG. 1 before bending.

FIG. 8 illustrates the metal plate M, which is the material of the spring contact 1A, blanked out from a metal plate by processing such as precision pressing. This metal plate M includes the base 10, a first portion M1 for the first elastic arm 11, and a second portion M2 for the second elastic arm 12. A length L4 of the first portion M1 is greater than a length L5 of the second portion M2. A thickness t of the metal plate M, which is, for example, around 0.07 mm (0.04 to 0.12 mm), is not limited to this range, and is determined in accordance with the specifications of the spring contact 1A, such as size and a spring constant. The first contact 30 is formed at the end of the first portion M1. The second contacts 50 and 51 and the through hole 52 are formed at the end of the second portion M2.

Figure 9:
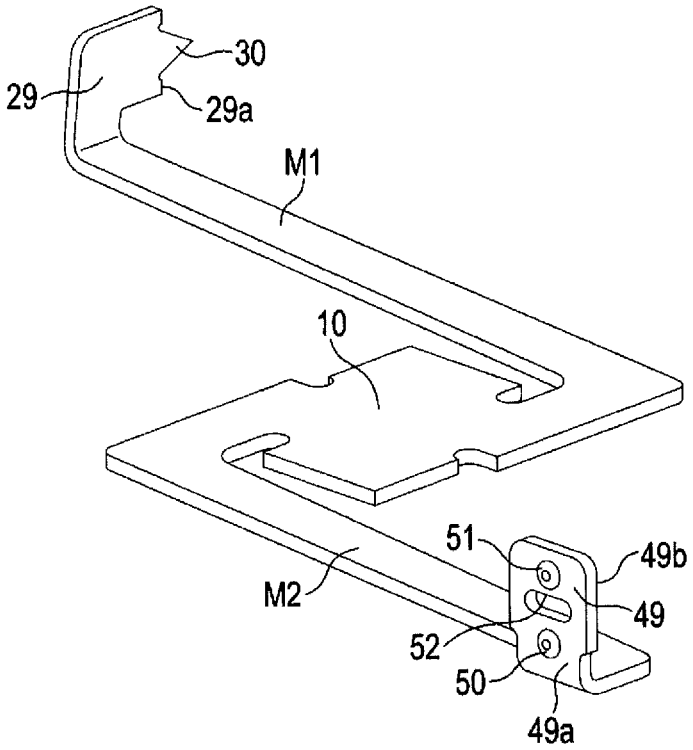
FIG. 9 is a perspective view of an intermediate product where part of the metal plate illustrated in FIG. 8 is bent.

As illustrated in FIG. 9, the first end portion 29 is formed by bending the end of the first portion M1 at a right angle. Furthermore, the second end portion 49 is formed by bending the end of the second portion M2 at a right angle.

Figure 10:
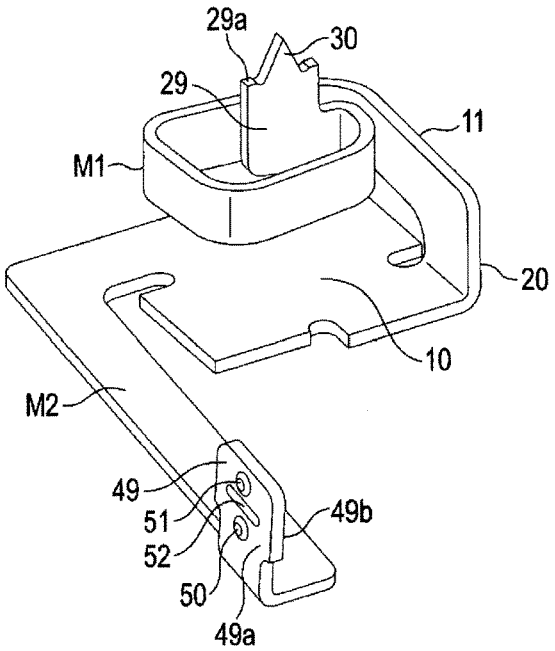
FIG. 10 is a perspective view illustrating a state where the first elastic arm is formed from the intermediate product illustrated in FIG. 9.

As illustrated in FIG. 10, the first elastic arm 11 is formed by helically bending the first portion M1.

Figure 11:
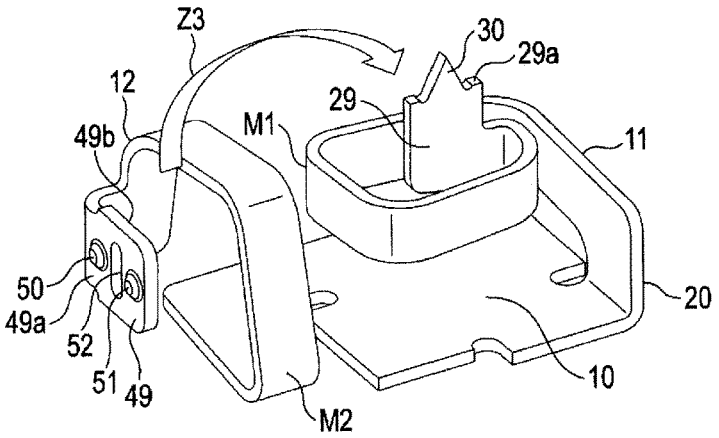
FIG. 11 is a perspective view illustrating a state where the second elastic arm is formed from the intermediate product illustrated in FIG. 10.
Figure 12:
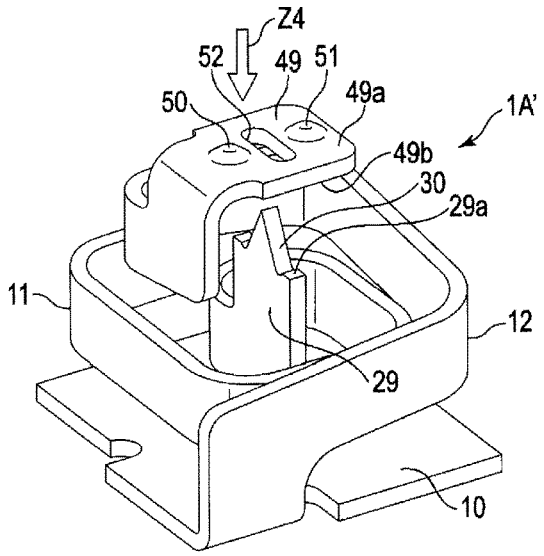
FIG. 12 is a perspective view illustrating a state where a fixed end of the second elastic arm of the intermediate product illustrated in FIG. 11 is bent at a right angle.

As illustrated in FIG. 11, the second elastic arm 12 is formed by helically bending the second portion M2. Thereafter, by bending the second elastic arm 12 at a substantially right angle in a direction indicated by the arrow Z3 in FIG. 11, an intermediate product 1A' illustrated in FIG. 12 is obtained. According to this intermediate product 1A', the end face 29*a* of the first end portion 29 and the back face 49*b* of the second end portion 49 face each other, being apart from each other.

By imposing a load from a direction indicated by the arrow Z4 in FIG. 12, the back face 49*b* of the second end portion 49 is brought into contact with the end face 29*a* of the first end portion 29, and the first elastic arm 11 and the second elastic arm 12 are simultaneously deflected. To be more specific, with the first elastic arm 11 being within the elastic limit, the first elastic arm 11 and the second elastic arm 12 are simultaneously deflected to a height at which the second elastic arm 12 goes beyond the elastic limit.

A greater permanent deformation is generated in the second elastic arm 12 than in the first elastic arm 11. Therefore, when the load is removed, the second elastic arm 12, whose amount of spring back is limited, cannot return to its original height. Therefore, the height of the second end portion 49 is slightly less than before the load is imposed. In contrast, the first elastic arm 11 tries to return to its original height through spring back. Therefore, as illustrated in FIG. 2, the end face 29*a* of the first end portion 29 contacts the back face 49*b* of the second end portion 49 with elastic energy being stored, so that an initial load is generated in the first elastic arm 11.

Thus, the method of manufacturing the spring contact 1A of this embodiment includes the following processes:

(1) forming the first portion M1 including the first contact 30 and the second portion M2 including the second contacts 50 and 51 in a material formed of a metal plate (FIG. 8);

(2) forming the first elastic arm 11 having a first spring constant by bending the first portion M1 (FIG. 10);

(3) forming the second elastic arm 12 having a second spring constant greater than the first spring constant by bending the second portion M2 (FIG. 11);

(4) disposing the first end portion 29 and the second end portion 49 such that the end face 29*a* of the first end portion 29 and the back face 49*b* of the second end portion 49 face each other with respect to a direction in which a load is applied (FIG. 12);

(5) simultaneously deflecting the first elastic arm 11 and the second elastic arm 12 such that the second elastic arm 12 goes beyond the elastic limit with the first elastic arm 11 being within the elastic limit by imposing a compressive load simultaneously on the first end portion 29 and the second end portion 49; and (6) with the load being removed, causing the end face 29*a* of the first end portion 29 to contact the back face 49*b* of the second end portion 49 and causing an initial load to be generated in the first elastic arm 11, through the amount of spring back of the second elastic arm 12 being smaller than the amount of spring back of the first elastic arm 11 (FIG. 2).

By adopting such a manufacturing method, it has been made possible to provide the first elastic arm 11 with an initial load (pre-tension) through the process of imposing a load simultaneously on the first elastic arm 11 and the second elastic arm 12, using the fact that the spring constant of the first elastic arm 11 is smaller than the spring constant of the second elastic arm 12 (the first elastic arm 11 is longer than the second elastic arm 12).

Figure 13:
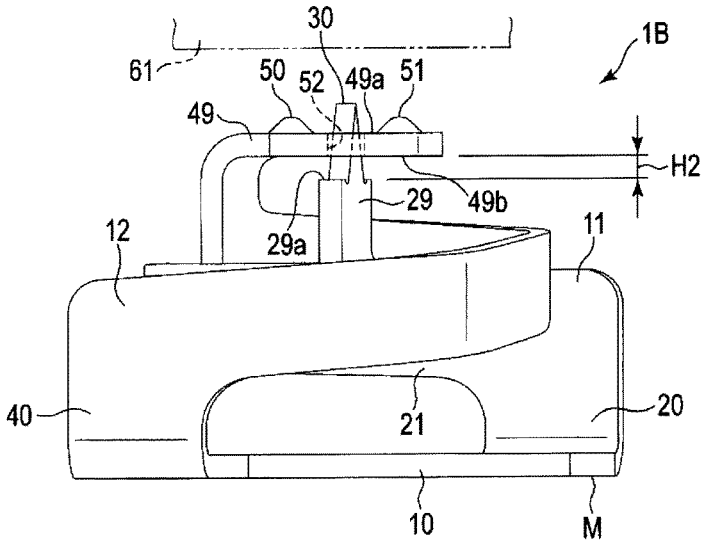
FIG. 13 is a front view of a spring contact according to a second embodiment.

FIG. 13 illustrates a spring contact 1B according to a second embodiment. According to this spring contact 1B, in a free state where no external force is applied, there is a gap commensurate with a height H2 between the end face 29*a* of the first end portion 29 and the back face 49*b* of the second end portion 49. Therefore, no initial load as described with respect to the spring contact 1A of the first embodiment is generated in the first elastic arm 11.

Figure 14:
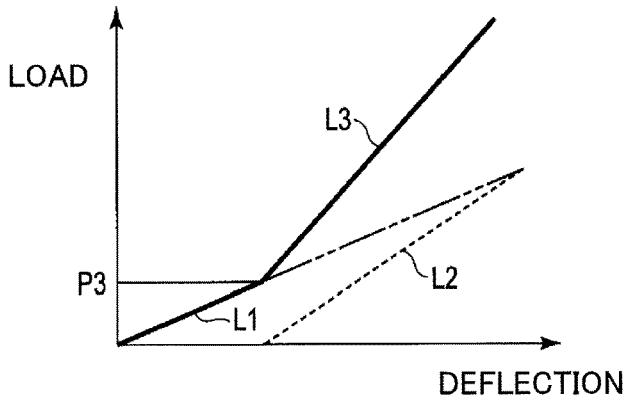
FIG. 14 is a graph illustrating a load-deflection relationship of the spring contact illustrated in FIG. 13.

FIG. 14 illustrates a load-deflection relationship of the spring contact 1B of the second embodiment. When the connection target member 61 (illustrated in FIG. 13) contacts the first contact 30, so that a load is imposed on the first contact 30, initially, the first elastic arm 11 alone deflects and the deflection therefore increases with an increase in the load as indicated by L1 in FIG. 14.

When the load exceeds P3 in FIG. 14, the second contacts 50 and 51 as well are pressed by the connection target member 61 to deflect the second elastic arm 12. Therefore, when the load exceeds P3, it becomes the same as the spring constant of the second elastic arm 12 (a load-deflection characteristic indicated by a dashed line L2 in FIG. 14) is added to the spring constant of the first elastic arm 11, thus resulting in a nonlinear load-deflection characteristic as indicated by a solid line L3. In other configurations and actions, the spring contact 1B of the second embodiment is equal to the spring contact 1A of the first embodiment, and therefore, both are referred to using the same numerals and a description thereof is omitted.

In the spring contact 1B of the second embodiment as well, the spring constant of the first elastic arm 11 and the spring constant of the second elastic arm 12 are different from each other the same as in the spring contact LA of the first embodiment. This makes it possible to prevent the first elastic arm 11 and the second elastic arm 12 from resonating simultaneously under vibrations of a particular frequency and causing the first contact 30 and the second contacts 50 and 51 to simultaneously separate from the connection target member 61, so that it is possible to avoid conduction failure due to vibrations.

Figure 15:
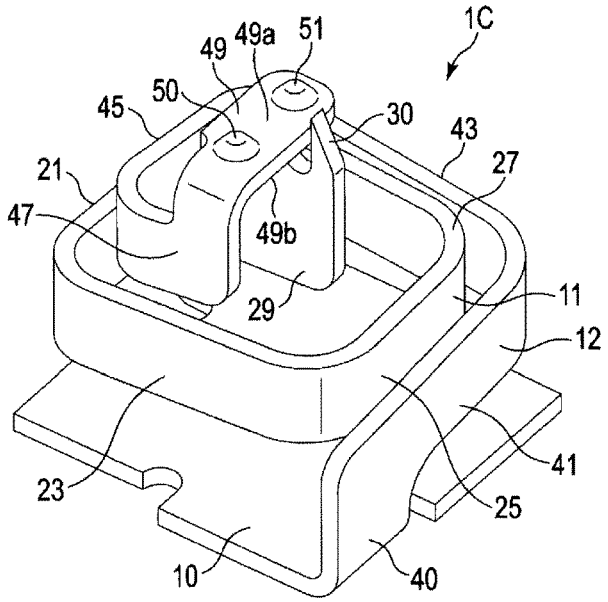
FIG. 15 is a perspective view of a spring contact according to a third embodiment.

FIG. 15 illustrates a spring contact 1C according to a third embodiment. According to this spring contact 1C, the first contact 30 is placed side by side with the second end portion 49 at a position off the second end portion 49 (a position offset relative to a side face of the second end portion 49) instead of forming the through hole 52 in the second end portion 49. The end of the first contact 30 protrudes outward (upward in FIG. 15) relative to the end face 49*a* of the second end portion 49. The number of first contacts 30 may be two or more, and the number of second contacts 50 and 51 may be one or more than two. In other configurations and actions, the spring contact 1C of the third embodiment is equal to the spring contact LA of the first embodiment, and therefore, both are referred to using the same numerals and a description thereof is omitted.

Spring contacts and a method of manufacturing the same are described above based on embodiments. The present invention, however, is not limited to the specifically disclosed embodiment, and variations and modifications may be made without departing from the scope of the present invention.

For example, in carrying out the present invention, various changes may be made in the specific shapes and arrangement of the base, the first elastic arm, and the second elastic arm of a spring contact and the form of a connection target part. Furthermore, spring contacts of the present invention may be applied to connections of circuits of various electronics, such as circuit parts of, for example, electronics to be installed in portable terminal devices, industrial machines, and transportation equipment including vehicles and airplanes, and medical devices.

What is claimed is:

1. A spring contact to which a compressive load is to be imposed, the spring contact comprising:

a base;

a first elastic arm of a helical shape, including a first fixed end supported on the base and a first end portion at a free end;

a first contact provided at the first end portion and protruding in a direction from which the compressive load acts;

a second elastic arm of a helical shape, including a second fixed end supported on the base and a second end portion at a free end; and a second contact provided at the second end portion, the second contact being placed independent of the first contact and protruding from the second end portion in the direction from which the compressive load acts, wherein the first contact and the second contact are configured to directly contact a connection target member when the compressive load is imposed.

2. The spring contact as claimed in claim 1, wherein an end face of the first end portion is placed to face a back face of the second end portion with respect to a direction in which the compressive load is imposed, and in a free state where the compressive load is not applied, an initial load is generated in the first elastic arm with the first end portion contacting the second end portion.

3. The spring contact as claimed in claim 1, wherein the second end portion includes a through hole, and the first contact is inserted in the through hole to have an end thereof protruding outward from the second end portion.

4. The spring contact as claimed in claim 1, wherein a spring constant of the first elastic arm and a spring constant of the second elastic arm are different from each other.

5. The spring contact as claimed in claim 4, wherein the spring constant of the first elastic arm is smaller than the spring constant of the second elastic arm.

6. The spring contact as claimed in claim 5, wherein a length of the first elastic arm is greater than a length of the second elastic arm.

7. The spring contact as claimed in claim 1, wherein the first end portion has a flat plate shape elongated in the direction from which the compressive load acts, and the first contact protrudes from a longitudinal end of the first end portion.

8. A method of manufacturing a spring contact, comprising:

forming a first portion including a first contact and a second portion including a second contact in a material formed of a metal plate;

forming a first elastic arm having a first spring constant and including a first end portion by helically bending the first portion;

forming a second elastic arm having a second spring constant greater than the first spring constant and including a second end portion by helically bending the second portion;

disposing the first end portion and the second end portion such that an end face of the first end portion faces a back face of the second end portion with respect to a direction in which a compressive load is applied;

simultaneously deflecting the first elastic arm and the second elastic arm such that the second elastic arm goes beyond an elastic limit with the first elastic arm being within an elastic limit by imposing the compressive load simultaneously on the first end portion and the second end portion; and with the compressive load being removed, causing the end face of the first end portion to contact the back face of the second end portion and causing an initial load to be generated in the first elastic arm, through an amount of spring back of the second elastic arm being smaller than an amount of spring back of the first elastic arm.

9. A spring contact to which a compressive load is to be imposed, the spring contact comprising:

a base;

a first elastic arm of a helical shape, including a first fixed end supported on the base and a first end portion at a free end;

a first contact provided at the first end portion and protruding in a direction from which the compressive load acts;

a second elastic arm of a helical shape, including a second fixed end supported on the base and a second end portion at a free end; and a second contact provided at the second end portion, the second contact being placed independent of the first contact and protruding from the second end portion in the direction from which the compressive load acts, wherein the first contact and the second contact are configured to be positioned in a same plane.

10. The spring contact as claimed in claim 9, wherein the first contact and the second contact are configured to have respective ends positioned in the same plane, the respective ends facing in the direction from which the compressive load acts.

* * * * *